US005481780A

United States Patent [19]

Daneshvar

[11] Patent Number: 5,481,780

[45] Date of Patent: Jan. 9, 1996

[54] CLEAN AIR VACUUM CLEANERS

[76] Inventor: Yousef Daneshvar, 21459 Woodfarm, Northville, Mich. 48167

[21] Appl. No.: 180,330

[22] Filed: Jan. 12, 1994

[51] Int. Cl.[6] ..... A47L 9/10; A47L 9/18

[52] U.S. Cl. ..... 15/339; 15/353; 15/347; 55/250; 55/255; 55/267; 55/334

[58] Field of Search ..... 15/353, 339, 347; 55/315, 318, 267, 250, 255, 334, 372

[56] References Cited

U.S. PATENT DOCUMENTS

| | | | |
|---|---|---|---|
| 923,547 | 6/1909 | Mayo et al. | 15/353 X |
| 1,454,381 | 5/1923 | Stepp | 15/353 X |
| 2,514,809 | 7/1950 | Soergel | 15/353 X |
| 2,539,867 | 1/1951 | Schnabel | 15/353 X |
| 2,631,688 | 3/1953 | Osborne et al. | 15/353 X |
| 4,627,858 | 12/1986 | Jacob | 55/267 X |
| 5,054,157 | 10/1991 | Werner et al. | 15/328 |
| 5,134,752 | 8/1992 | Shipman | 15/422.2 X |

*Primary Examiner*—Chris K. Moore

[57] ABSTRACT

This invention introduces a new series of vacuum cleaners or a special cover for them in which the unit will have a mechanism to prevent polluted air going out via the walls of the collection bag of the commonly used vacuum cleaners to enter into the house. This method uses different methods such as burning the smaller particles and elimination of the burned gases to prevent pollution of the room air. This unit is believed to be very beneficial in preventing the problems due to the release of these small particles into the room.

21 Claims, 5 Drawing Sheets

CLEAN AIR VACUUM CLEANERS

THE BACKGROUND OF THIS INVENTION

The invention is about the prevention of air pollution by cleaning machines and particularly by vacuum cleaners. Air is one of the most essential needs for human beings and is the essence of life. In general, inhalation of polluted air causes many diseases and much concern and it is extremely important to avoid inhalation of polluted air in order to prevent disease.

Unfortunately, cleaning agents themselves are a part of the problem and many of the commonly used vacuum cleaners dispense many tiny particles with outgoing air from their disposable bags. This is a cause of pollution in the home environment and should be avoided. The inventor has noticed this problem and introduces a solution for it.

THE BRIEF EXPLANATION OF INVENTION

This invention deals with making special kinds of vacuum cleaners so that the bag of these units or the containers of these units will not emit small particles into the room's air. In these new units, the polluted air, contaminated with many tiny particles that have escaped the container of the vacuum cleaner will be trapped inside a non-porous cover which will allow appropriate dispension of the polluted air to be done.

THE FIGURES

Figure 1:
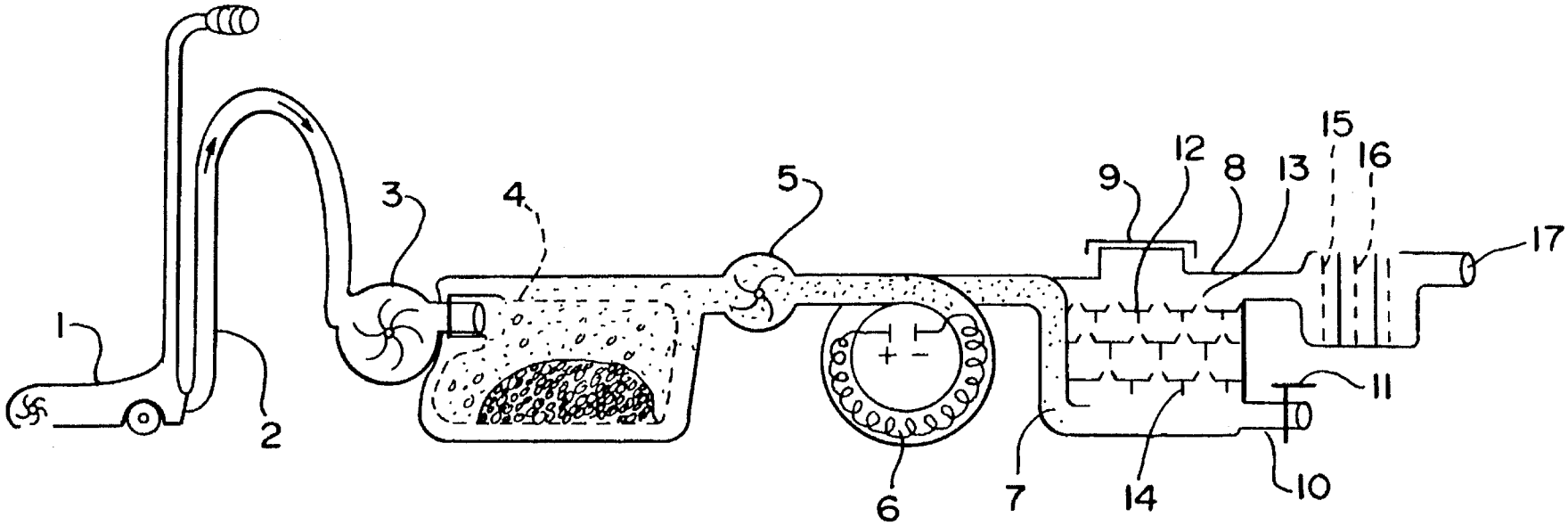

FIG. 1. This figure is a schematical figure to show the different components of this unit. In this figure the piece that will suction the dirt from floor like a regular but high quality vacuum cleaner is shown at 1 and the flexible connected hose at 2 which is connected to the main suction machine shown at 3. The suctioned dirt will then be dropped inside a disposable bag of 4 which is shown at broken line. This bag has a wall that is like a filter and will only allow air and very tiny particles to leave it. No 5 shows another suction fan that is to make the air move and not to be stagnant. No 6 shows a spiral shaped burner which has a filament that will provide a red hot heat. No 7 shows a tube that caries the polluted air into the bottom of the purification bottle. This bottle has layers of plastic, one is shown at 12 which has small domes, one is shown at 13 with a small opening in its tip and small vertical walls, one is shown at 14 that will cut air going out of the holes to break into pieces and divide. No 10 shows a hose for releasing the fluid from this container, and no 11 is a valve. No 15 and 16 are different filters and no 17 allows clean air to leave the unit. One important job of one of the filters will be to remove humidity from outgoing air. One of them may add proper aromas to it.

Figure 2:
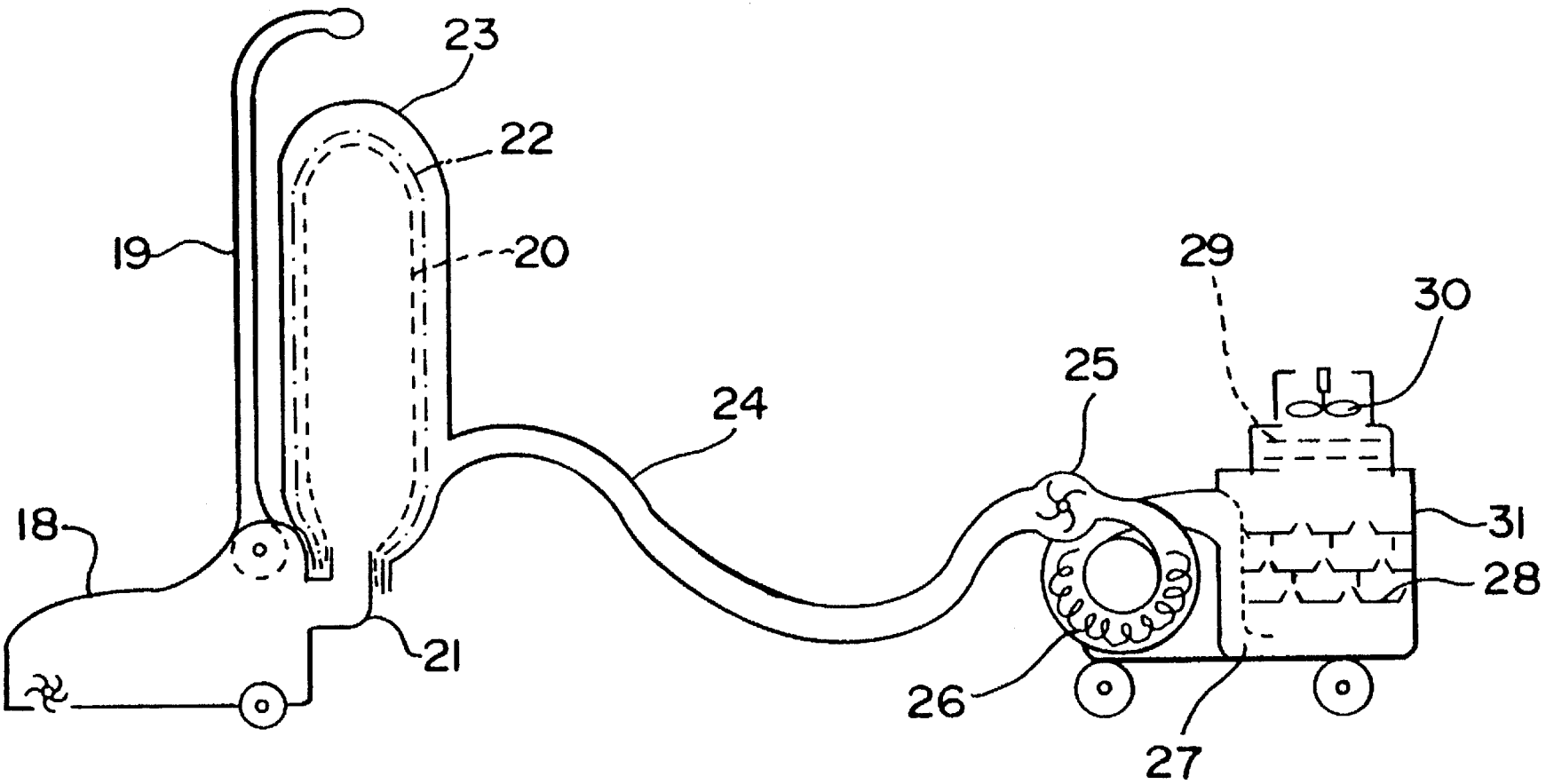

FIG. 2. This figure is a schematical figure to show the general design of a model which is to be attached to an upright type vacuum cleaner that is presently and commonly used. This unit consists of a cover 23 that will go over the two previous covers of the vacuum cleaner. No 20 is the disposable bag of the vacuum cleaner and 22 is the plastic cover which commonly is used to cover the disposable bags in these models of the vacuum cleaners. Importantly, creases or small pieces, folds or plastic pieces will be placed between the plastic 22 and the new cover 23 from the new unit. Otherwise, the plastic 22 will be suctioned and stuck into the wall of the cover 23 and will prevent the function of this unit. So, importantly there will be a distance between cover 22 and 23 which will hold the polluted air inside and allow it to be suctioned via the tube 24. The tube 24 will take the polluted air which comes out of disposable bag of the vacuum cleaner and, with help of a suction fan of 25, will take it into the burner 26. The burner 26, which is powered by electricity from the vacuum cleaner, will bum all the small particles of the polluted air and then the rest of the air and gases will be taken into the purification bottle of 31. No 27 shows the opening of the tube in the bottom of the purification bottle, and no 28 shows a flat layer inside the purification bottle. In this unit, a series of layers of different filters are placed horizontally above the purification bottle and are marked at 29. A suction fan 30 is placed above these filters that will facilitate and pull the air through the filters. If the air was not totally cleaned, tubing will take the air from here to release it out in the same ways as mentioned above. A similar but modified model of this unit may be made to be used with the other models as well.

Figure 3:
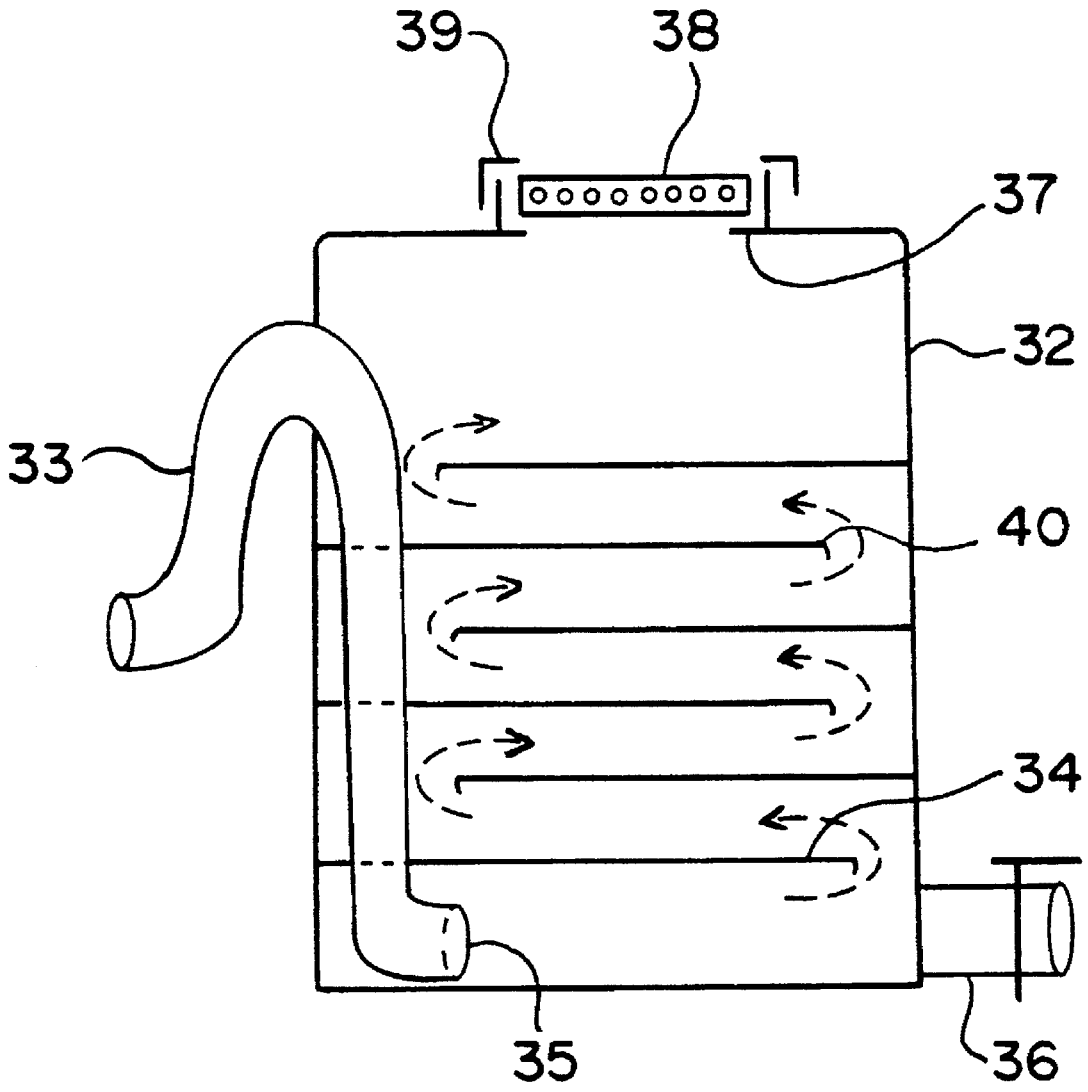

FIG. 3. This figure is a schematical cross cut figure from a purification bottle which is made from plastic and will hold water or other solvents inside it so that the polluted air could be mixed so water or a solvent could absorb the particles from polluted air. (Some times the particles will absorb water molecules to get larger and be absorbed by the filters) In order to increase the chance of this mixture, this bottle has a series of horizontal layers that will make the air to go thorough and mix more. The bottle has a drain 36 and it has a place 37 for the placement of filters and a cap 39 to hold the filters in place. In this figure the body of the unit is shown at 32 with the incoming tube at 33 and its lower end at 35 one horizontal layer at 34 and its tip which is bend down at 40. The broken arrows show the direction of the motion of the air.

Figure 4:
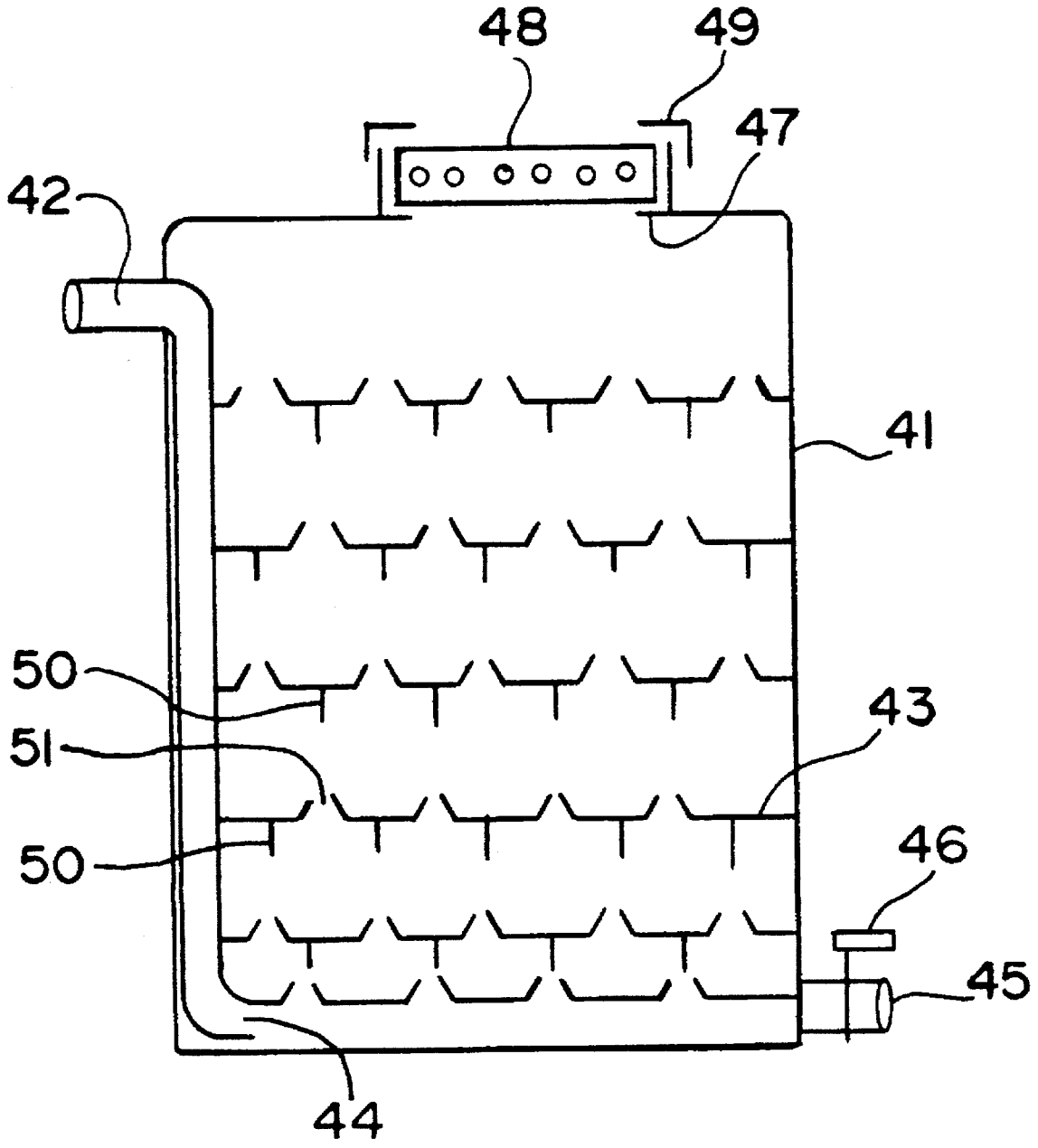

FIG. 4. This figure is a schematical cross cut figure from an another model of purification bottle. It is also made from plastic and will hold water or other solvents inside it. This unit however has a series of horizontal layers inside, one shown at 43 and these layers have a series of small domes such as 51 with a hole at its end. These are made to allow the air to break into smaller pieces and mix during its passing inside the solvent. The lower surface of these horizontal layers has a series of vertical walls shown at 50 which corresponds with the opening of the domes and in three dimensional view, have a cross cut shape so that the outgoing air from the hole of the domes will be broken by these walls to pieces to mix more with the solvent. In this figure the body of the bottle is shown at 41 the incoming tube is at 42 the lower opening of it at 44. The drain 45 and its valve 46 are shown. This unit also has a place 47 for the placement of filters 48 and a cap 49 to hold the filters in place. In this figure one horizontal layer is marked at 43 and the top of the dome at 51 and the vertical walls at 50.

Figure 5:
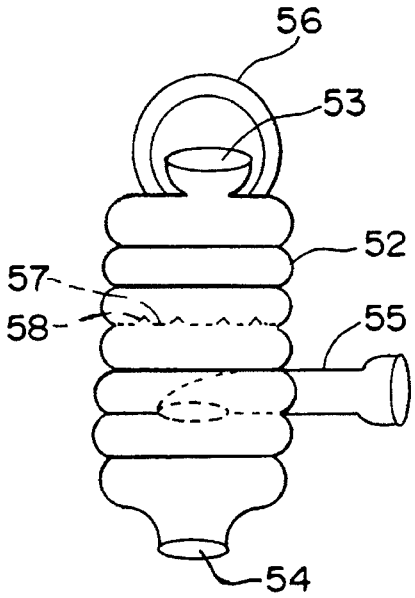

FIG. 5. This figure shows a plastic piece that is to allow the polluted air to be washed out into a sink. This unit will be made like an accordion to be expandable and fit the drains with different distance than the faucet. In this figure the body of this unit is shown at 52 its upper opening at 53 that will fit the tip of the faucet, and the elastic band 56 will go over the faucet to hold the unit in place. Its lower end 54 will fit the drain. The tube 55 will be temporarily connected to the tubing from the vacuum cleaner and will bring the polluted air inside. The perforated layer of 57 has sharp indentations of 58 to cause the incoming water to disperse, mix and flush the air better.

Figure 6:
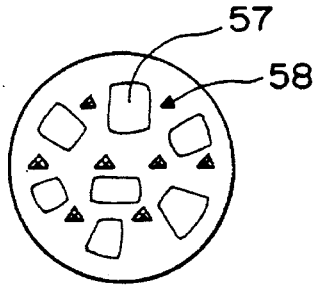

FIG. 6. This figure shows the perforated layer inside the previous unit. In this figure the sharp parts are shown at 58 and the openings at 57.

Figure 7:
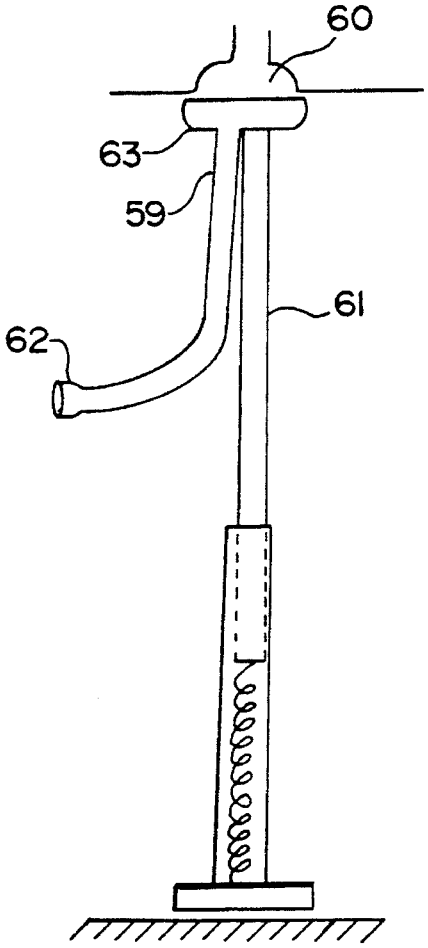

FIG. 7. This figure shows a telescopic pole 61 holding an expanded piece 63 against the opening of the ceiling of the bath room 60 so that the tube 59 will carry the polluted air and allow it to be blown out by this technique. The opening 62 will be connected to the tubing from the vacuum cleaner.

Importantly, these figures are only to show the basic ideas of making these units, and it is easy for a knowledgeable person in this field such as skillful examiners of the PTO to understand that these units can be easily made with these components and to be compact and likeable, and for this the engineering rules will be utilized to have the models made.

THE DETAILED EXPLANATION OF THIS INVENTION

This invention deals with making a special kind of vacuum cleaner and special covers for the presently used ones. These units, due to their design, will prevent tiny particles that leave the collection bag of the vacuum cleaner with air to disperse in the air of the room. This is an important issue since these particles, if not trapped or destroyed, not only will finally sit on the floors and furnitures as fine dust, but also they can be aspirated to go into the nose, mouth, throat and the lungs of the people, as well as to cause acute and chronic problems. A vicious cycle will start next time when the room is vacuumed again. However, this vicious cycle will be broken by these new units since in these cases the polluted air from the sac or bag of vacuum cleaner will be moved into a purification unit that this unit is to burn, destroy and filter the germs, pollens, allergens and tiny particles that are hazardous to the body. This unit will be very effective in killing all the germs since it will burn them out totally. The other small and hazardous particles will be destroyed to ashes as well. So at the end the material will mostly changed to be gases and a very tiny light weight ashes may be left as well.

Basically, this unit will be similar to the commonly used vacuum cleaner. They will have suction pieces and rotating brushes or brooms to suction the dirt from floor and the machinery to carry them into a container which has the disposable collection bag. Commonly, the larger particles and even the smaller materials will be collected inside these bags to be disposed with the disposable bags later. However, during the suctioning, a large volume of air is commonly blown inside the bag that has to leave the bag via the tiny holes in its wall. Unfortunately, the air does not leave in pure form and it carries an infinite number of very tiny particles out with itself which can't be visualized by the naked eye. However, an important experiment of this inventor proved that they do exist and are not wanted materials to be inhaled either. The inventor had his own thoughts in this regard and finally, to prove his view, he once did the following very interesting simple experiment. This was done in his own home and on one sunny day of Detroit, Mich. when the morning sun was shining through the window of one of his second floor rooms coming into the hall. Then he had someone turn the vacuum cleaner on in the right spot when he was observing the small particles seen along the beam of the sun. Perhaps it should be said that the inventor is an interested physician with years of experience. The experiment showed a very interesting phenomenon that almost immediately after turning the vacuum cleaner on, there was an enormous numbers of fine particles that went all around and many feet away in the direction of the air which was blown. The study was halted very quickly since it was noted how easily the air could be polluted and inhaled when people are not aware of such heavy pollution. Importantly, and unfortunately, these particles can not be visualized during common use of these vacuum cleaners, when the circumstances are not right for observation. This very important experiment proved one belief of the inventor that unfortunately there is a significant problem with the make up of the presently available vacuum cleaner that needs to be corrected. Unfortunately, circumstances have not allowed for him to repeat his experiment and to study it more thoroughly yet. Although he has the intention to repeat the condition and to try to photograph and record them and also to see how long it will take to have these particles to precipitate, it is also very important to study the effects of these particles in human health as well as specially on their respiratory system. However, this study made this inventor even more eager to introduce his own models and the improved version of vacuum cleaners, which in these models, the dirt will be delivered into the bags similar to the commonly used disposable bags of vacuum cleaner; however, the air which leaves these collection bags and has innumerous numbers of such fine particles will not be released into the air, since these vacuum cleaners will be made to gather and destroy them by use of the following characteristics:

1. The suction part. These units will have parts such as rotating brushes and suctioning engines similar to the regular vacuum cleaners that suction the dirt from the floor and carpet and similar areas inside. This will be done with the use of nozzles, brooms, suction devices and motorized suction devices that all collectively will sweep over the carpet to suction the dirt and small particles basically in the same way that the commonly available quality vacuum cleaners do. Then the engine and design of these units will move the collected materials (here referred collectively as a "Dirt") inside a collection area that usually has a disposable bag. This function is usually intensified by a powerful engine that blows the dirt into a collection bag. Self-propelling models will also be used. These will be made in canister or upright models or other popular models as well. The unit may have proper lighting as well.

2. The collection bags. These new units will also have collection bags which will be similar to bags made for the commonly used vacuum cleaners. These bags will be made from a porous paper or combinations of plastic and paper or some synthetic materials and their combinations. This bag will have a wall which will function like a filter to only allow air to pass through and to release the materials with the air as less as possible. The release of these particles is involuntary and due to the limitation of the technique, are to be kept inside as much as possible. This bag will be shaped in different shapes to fit inside different models of the vacuum cleaners. However, in the prototype model it will be shaped to accept the dirt from the side or its top so that the dirt will fall in its floor and sides depending on their weight and the effect of gravity, and only very tiny particles will leave the bag with the moving air and through the micro holes of the walls of the bag. These tiny particles, however, would not be set free to enter the room and be part of the room's air. This air will be referred as "the polluted air" and will be kept inside a non-porous cover that will prevent anything (even the air) to go through it. However, it will have a hose to take this polluted air into one of the following disposition areas.

A. Into free air which has good circulation. This may be done only where the air motion is strong enough to move the particles and prevent from polluting the area, or be inhaled by a person nearby or to cause other problems.

B. Into the sink to be flushed via the sink by the use of the unit shown at FIG. 5.

C. Into the air via an outlet in the nearby rest room by the unit shown at FIG. 7.

D. Into a burner

An extra suction fan or fans may be placed along this line and be used to direct this air more forcefully to its destination and prevent smaller particles to be deposited and the movement of the air to slow down. The tubing may have special spaces and containers to allow the dirt to drop inside if the particles aggregated.

If the polluted air was not disposed, it will be moved into a special place here referred as "The purification chamber". The polluted air will be challenged inside this chamber by different means in order to loosen its particles and various tiny hazardous components inside it.

This purification chamber will have a spiral tunnel to burn the dust. (it can have a zig zag shape or any other configuration as well) This tunnel will be made from metal, ceramic or any other similar heat resistant materials or their combinations that may serve this purpose and it is to provide a "Red Heat" with the use of electricity and properly shaped heating filaments inside or in their outside or the wall, so that the exposure will burn all the small microscopic materials inside the polluted air such as viruses, bacteria, yeasts, pollens, small particles of any fabrics, even molecules with bad odors and any materials that can burn. The inventor believes that this will purify the air thoroughly and eliminate any allergens, germs and unwanted particles. It will allow reduce the volume of the particles significantly, since many of those simply will burn out and the others will change to tiny microscopic ashes that will move with the air. Then there will be a hot air mixed with a tiny polluted gas that needs to be managed. By this time the air is much less heavier and will move a long way easily inside the tubes. These gases will not be released to the air and will be disposed or directed into one of the following places:

A. Into free air.

B. Into the sink to be flushed via the sink by the unit shown at FIG. 5.

C. Into the air via an outlet in a close by restroom by use of the unit shown at FIG. 7. Or from the opening of the window or door.

D. Into a purification and modification bottle.

Again an extra suction fan or fans may be used along these lines and tubings to direct the air more forcefully and prevent from its deposits along it. These tubings can be smaller ones which can be handled easily.

Importantly, instead of burner a flame or an ultrasonic methods. Also the particles may be charged with electricity and absorbed by an electrical field as well. This can be a highly charged electrical field as well. Any other suitable and functional methods may be also used instead of the burner to absorb and gather or to destroy these particles.

If the air was not released it may be put into a "Purification Bottle" similar to the one that was previously introduced to PTO in the inventor's previous application of Pollution Removing Device 3. The Purification Bottle. This will be a unit similar to the one introduced in the application of Pollution Removing Device and shown in FIG. 7 from that application (a copy included). This will be a special plastic container that will be filled with water or any other proper solvent for this purpose. This Purification bottle will have a series of horizontal layers made from plastics as shown in FIG. 7 and 13 and as explained in those figures. The main jobs of these layers are to cause dispersion of the air inside the liquid of the container and changing it into smaller bubbles so that the contact of the polluted air and the water or solvents will be longer so that more of its contents will dissolve in the water/solvent and also the air will lose its temperature. FIG. 13 is from the same application and also shows how another model of a container with a series of horizontal layers may be used in 2 in which these layers will have a series of small domes throughout their surface with small openings on their tips shown at 75 in order to make the incoming air to be cut to smaller bubbles in order to mix with the water more. Small walls in the lower surface of these layers will also function to cause air bubbles coming up from opening 75 to disperse even more the smaller bubbles and mix with the liquid more.

Importantly, as it was mentioned in that application, in certain models of these bottles, an electrical engine may be used to turn a series of mixing blades inside this container to mix the air even more with water/solvent. The shapes of these blades, their number, their rotational directions, their speed and the other important characteristics of these units and blades may all vary to give a maximum absorption capacity into the liquid of this unit.

Instead of water, this container may be filled with a liquid containing different materials such as disinfectants, solvents, perfumed solutions etc. in order to cause one favorable effect or another.

Importantly, in some cases it is possible to use a series of such bottles to let the air go through a series of these liquids, each one to be used for a certain purpose, although not all of these bottles may need to be sophisticated to have the blades etc. And the last bottle may only contain perfumed water so that air would go inside it. It is believed by the inventor that this process will eliminate all the germs and most of the unwanted materials from the polluted air, and it will make the air cooler to a certain degree. By this time, the air would be safe enough to enter the room. Alternatively it may be disposed by one of the means mentioned above.

4. Use of filters: After the exposure to the water/solvent then the air will be exposed to a series of the filters which will be decided according to the condition of the place or that environment; for example, if the air was wanted to be dry then a filter will be used to absorb the moisture. If there is a bad odor left then a series of charcoal filters or similar filters will be placed in the way to absorb the bad odor. These may be placed in the sides or even on top of this container or its top corner and held properly by a cap in order to absorb the remaining bad odor. These filters will be nicely placed so that they can be exchanged, removed or entered in the way easily without need a screwdriver or anything.

A perfumed filter or water may be also used (and be placed after the charcoal filter) in order to give a special and nice smell to the outgoing air and the amount of this exposure can be controlled. The perfumed water can be easily vaporized to deliver its refreshing smell as well.

5. A suction fan may be placed on the outlet of the container in order to allow the air to be suctioned easily.

Some more discussions about the auxiliary pieces:

Use of suction fans:

a. These units will be a number of suction fans, which are designed to suction the air and materials and prevent stagnant or low speed air. These fans will be powered by electricity and will be placed in certain spots along the lines and tubing of these units in different places in order to suction the air and to keep it moving all the time and prevent deposits to drop in the bottom due to gravity. A control part may also be used to allow its force to be controlled. The size, shape, location, and strength or power of this fan all will depend to the model and the size of the unit and its purpose. This fan and the burner will be controlled by a programmer. The programmer will allow the timing and the strength and the other factors of this fan to be changed and controlled.

b. The burner. This will be a unit made to have a heating coil kept inside a well insulated space that will allow the heating coil to function in red heat without being the cause of fire or other sources of problems. This coil and its cover may be made to have a spiral shape as shown in FIG. 1 in order to make the tiny particles to be properly exposed to heat and be burned out without having a chance to escape the unit. It many be made in any different shapes as well such as being straight, zig zag, curved, rectangle, circular, flat, or any other possible shapes that will fit the size and shape of a particular unit or the need for insulation etc. The duration of function, direction, temperature and other important functional aspects of this part may be chosen to be controlled by a programmer. The place of the coil may be inside, in the wall or outside of the wall of the burner tube. The burner tube may have extra short walls that will be perpendicular to the inner surface of its inner wall and/or curves in its inner surface or other mechanism to increase the chance of contact and capturing the particles of the polluted air. The possible state of art technology will be used to make these units serve the purpose best.

Importantly, this unit may be made to function in two directions: one in the normal direction to suction and burn the polluted air as explained. The second is to have a reverse direction in order to suction the air from outside or from an opening with the use of the same fans or by using another fan to blow the air inside the unit in the reverse direction when desired from time to time in order to clean the unit with fresh air and blow the deposited particles in the walls away.

A series of openings may be placed anywhere which are needed to allow cleaning of the unit to be done.

c. Use of programmer: The fan, the burner, the engine and suction parts of these units will be controlled by a controller or programmer. The programmer will allow the timing, the strength and the other factors of these units to be changed, adjusted and controlled. This programmer may be electrical or electronic. The unit may allow the temperature of the outgoing air to be changed as well so that the temperature to be changed due to season and environment that is used.

d. Use of telescopic dishes: As an extra piece these units may have an opening into air by a hose or similar piece or by a telescopic dish so that it could be directed and held in special directions and places to suction the air and remove its particles. During this function, the vacuuming part will be bypassed and non functional. The dish will allow to choose the direction which the air is wished to be suctioned.

e. Electrically charged ions may be added to this unit in order to charge the particles and to attract them later to a particular side and area.

f. How may these changes ;affect the shape of the vacuum cleaners? Basically the main suction parts will be the same and without much change. The shape of the cover of the bags and canisters will change since these are going to be airtight, so they will be made from plastic or metal. Their connection lines will have rubber pieces or construction to prevent air from leaving the space. The rest of the new materials will be engineered to be as compact and small and nicely-shaped as possible. They may be separate or may be connected and be part of the body of the vacuum cleaners.

After air is cleaned and treated by these methods it will be safe enough to be released back to the room; however, options will be left open to have it be released into a sink or by a piece held by a telescopic pole or similar means to an outgoing opening of a house, or by small tubing to the outside via opening of the window or door.

Importantly, different units may be made from combinations of different parts which were mentioned above, so that different models will fit the different needs and function best.

This unit may have different models. In one model, the unit may not even have a place for accumulation of the dirt. This will be a model in which the area which is to be cleaned does not have much dirt; in such case, the small amount of the materials and dust may simply be burned out, since it may not be more than a handful. These units may be made to be small and hand-held. A place would hold the ashes for disposal. Another model may be same as the one mentioned earlier but it may also have a small purification bottle as well. In another model the main model may have a built-in alternative route that will allow the dirt to be bypassed and deviated from the bag and to be taken into the burner directly. This will provide a nice choice to the user to decide which one of the two alternatives to use for the area that he/she is cleaning.

This unit will also have an adjustable piece that can be placed inside a widow or door in order to allow only a small opening to be left and be used for allowing the air to be released.

The unit for dispersing and flushing the polluted air by use of the sink is shown at FIG. 5. This unit will allow the dirt to be washed out during suctioning rather than to be inhaled. A device to allow the air to be released to the outlet of bath rooms or similar places is shown at FIG. 7.

Different Models:

In general, many different models may be made with the use of components mentioned in this text. These can be made to be used as a new model or a unit that may be used with presently used vacuum cleaners of different shapes. These will be grouped as follows:

1. A unit Model A that is made from a non-porous plastic, metal, similar materials or their combinations that will be placed over the container or bag of the commonly used vacuum cleaners so that it will seal the unit and would not allow the air to leak out and only to be directed into a tubing that will remove it. This tubing may be connected outside to dispose the polluted air.

2. The second unit Model B will be similar to the one mentioned in the previous model A, except in this model the moving of the air will be enhanced by a suction fan as well.

3. The Model C will be similar to model B except it may have a burner to eliminate the tiny particles as well. Then the air is to be exposed outside. This model may also have filters as well.

4. The Model D will be similar to model C except it will have a purification bottle instead of burner in order to absorb the tiny particles inside its own solution.

5. The Model F will be similar to model C except it will also have the purification bottle and filters as well.

6. The Model E will be similar to model F except it will also have special tubing arrangements and valves that will allow one piece of this unit such as the burner or the purification bottle or so to be bypassed.

7. The Model G will be similar to model C or D except it will be made to be small and to be hand-held.

8. It is to be considered that all these models will/can be fortified by the use of the units that make good vacuum cleaners so they will allow these units to suction the dirt inside. Such pieces like rotating brushes are commonly used in vacuum cleaners. Also, powerful suction machines will be included so that they will help suction dirt inside the disposal bag, etc. What the inventor means is that a very high quality vacuum cleaner of any type or models (such as upright, hand held smaller unit or large canister units) will be made to be used except they will have these units incorporated on them to make the great advantage of not releasing the polluted air inside the house.

It can be understood how many combinations may be made with using these teachings to allow different models to be available for different jobs and uses.

I claim:

1. A clean air vacuum cleaner comprising:

a) an upright-type vacuum cleaner comprising an air-permeable disposable dirt collection bag that is contained within an upright air-permeable cover bag, an electric powered fan for suctioning dirt into a suction air stream and blowing the dirt-entrained air into said air-permeable disposable dirt collection bag; and b) a non-permeable upright enclosure enclosing said air-permeable cover bag for containing air and minute air-entrained matter that has passed through both the disposable dirt collection big and the air-permeable cover bag, said enclosure having a side extending alongside the cover bag;

c) said enclosure having an outlet in its side through which the contained air and minute air-entrained particles can exit the enclosure; and d) suction means connected to said side outlet for drawing the contained air and minute air-entrained particles from said enclosure to a disposal means.

2. A clean air vacuum cleaner as set forth in claim 1 including spacing means acting between said cover bag and said enclosure for keeping said cover bag spaced from said enclosure such that when suction force is created by said suction means, spacing is maintained between said cover bag and said enclosure to prevent said cover bag from being sucked against said enclosure, and hence prevent flow through said cover bag from being substantially obstructed by said enclosure.

3. A clean air vacuum cleaner as set forth in claim 1 in which said suction means comprises an electric powered fan.

4. A clean air vacuum cleaner as set forth in claim 3 in which said disposal means comprises incinerating means through which the air and minute air-entrained particles are passed to incinerate at least some of the particles.

5. A clean air vacuum cleaner as set forth in claim 4 in which said incinerating means comprises an electric-powered incinerating element.

6. A clean air vacuum cleaner as set forth in claim 5 in which said disposal means further includes a purification bottle for containing liquid through which air, any unincinerated particles, and products of combustion of incinerated particles pass after leaving said incinerating means for removing heat and at least some of the air-entrained matter.

7. A clean air vacuum cleaner as set forth in claim 6 in which said purification bottle comprises a series of horizontal baffles having openings to form a tortuous upward flow path through the bottle for the air and air-entrained matter.

8. A clean air vacuum cleaner as set forth in claim 7 including an absorbent filter element on the top of said bottle through which the cleaned air passes as it leaves the bottle.

9. A clean air vacuum cleaner as set forth in claim 8 including a further suction fan downstream of said filter element for assisting in drawing the cleaned air through the filter element.

10. A clean air vacuum cleaner as set forth in claim 1 in which said disposal means comprises a purification bottle for containing liquid through which air and air-entrained particles passes after leaving said enclosure for removing at least some of the air-entrained particles.

11. A clean air vacuum cleaner as set forth in claim 10 in which said purification bottle comprises a series of horizontal baffles having openings to form a tortuous upward flow path through the bottle for the air and air-entrained particles.

12. A clean air vacuum cleaner as set forth in claim 11 including an absorbent filter element on the top of said bottle through which the cleaned air passes as it leaves the bottle.

13. A clean air vacuum cleaner as set forth in claim 12 including a suction fan downstream of said filter element for assisting in drawing the cleaned air through the filter element.

14. A clean air vacuum cleaner comprising:

a) a vacuum cleaner comprising an electric powered fan for suctioning dirt into a suction air stream and blowing the dirt-entrained air into an air-permeable dirt collection bag;

b) a non-permeable enclosure within which said air-permeable dirt collection bag is disposed and which contains air and minute air-entrained matter that has passed through the dirt collection bag;

c) said enclosure having an outlet through which the contained air and minute air-entrained particles can exit the enclosure; and d) suction means, comprising electric-powered fan means, connected to said outlet for drawing the contained air and minute air-entrained particles from said enclosure to a disposal means; and e) said disposal means comprising incinerating means through which the air and minute air-entrained particles are passed to incinerate at least some of the particles, and a purification bottle for containing liquid through which air, any unincinerated particles, and products of combustion of incinerated particles pass after leaving said incinerating means for removing heat and at least some of the air-entrained matter.

15. A clean air vacuum cleaner as set forth in claim 14 in which said incinerating means comprises an electric-powered incinerating element.

16. A clean air vacuum cleaner as set forth in claim 14 in which said purification bottle comprises a series of horizontal baffles having openings to form a tortuous upward flow path through the bottle for the air and air-entrained matter.

17. A clean air vacuum cleaner as set forth in claim 14 including absorbent filter means on the top of said bottle through which the cleaned air passes as it leaves the bottle.

18. A clean air vacuum cleaner as set forth in claim 14 in which said electric-powered fan means includes a suction fan downstream of said absorbent filter means for assisting in drawing the cleaned air through the absorbent filter means.

19. A clean air vacuum cleaner comprising:

a) a vacuum cleaner comprising an electric-powered fan for suctioning dirt into a suction air stream and blowing the dirt-entrained air into an air-permeable dirt collection bag;

b) a non-permeable enclosure within which said air-permeable dirt collection bag is disposed and which contains air and minute air-entrained matter that has passed through the dirt collection bag;

c) said enclosure having an outlet through which the contained air and minute air-entrained particles can exit the enclosure; and d) suction means, comprising electric-powered fan means, connected to said outlet for drawing the contained air and minute air-entrained particles from said enclosure to a disposal means;

e) said disposal means comprising a purification bottle for containing liquid through which air and air-entrained particles passes after leaving said enclosure for removing at least some of the air-entrained particles, including absorbent filter means on the top of said bottle through which the cleaned air passes as it leaves the bottle; and f) in which said electric-powered fan means includes a suction fan downstream of said absorbent filter means for assisting in drawing the cleaned air through said absorbent filter means.

20. A clean air vacuum cleaner as set forth in claim 19 in which said purification bottle comprises a series of horizontal baffles having openings to form a tortuous upward flow path through the bottle for the air and air-entrained particles.

21. A clean air vacuum cleaner as set forth in claim 19 further including between said enclosure and said bottle, an electric-powered means for removing some particulate material before it reaches the bottle.

* * * * *